US011065737B2

(12) United States Patent
Hirono

(10) Patent No.: US 11,065,737 B2
(45) Date of Patent: Jul. 20, 2021

(54) NEEDLE-NOSE PLIERS

(71) Applicant: Kohei Hirono, Hyogo (JP)

(72) Inventor: Kohei Hirono, Hyogo (JP)

( * ) Notice: Subject to any disclaimer, the term of this patent is extended or adjusted under 35 U.S.C. 154(b) by 278 days.

(21) Appl. No.: 16/346,952

(22) PCT Filed: Nov. 10, 2016

(86) PCT No.: PCT/JP2016/083358
§ 371 (c)(1),
(2) Date: May 2, 2019

(87) PCT Pub. No.: WO2018/087859
PCT Pub. Date: May 17, 2018

(65) Prior Publication Data

US 2019/0321944 A1 Oct. 24, 2019

(51) Int. Cl.
*B25B 7/02* (2006.01)
*B25B 7/08* (2006.01)

(52) U.S. Cl.
CPC . *B25B 7/02* (2013.01); *B25B 7/08* (2013.01)

(58) Field of Classification Search
CPC .... B25B 7/02; B25B 7/04; B25B 7/08; B25B 7/20; B25B 7/22; B25B 7/123; B25B 13/505; B25C 11/02; A61C 3/14; H02G 1/1275; H02G 1/1212; H02G 1/1214; H02G 1/1224; H02G 1/1229; G02B 6/245
See application file for complete search history.

(56) References Cited

U.S. PATENT DOCUMENTS 3,831,207 A * 8/1974 Boyajian ..... B25B 7/02 7/107
8,176,814 B1 * 5/2012 Bernstein ..... B21F 1/002 81/9.4
2014/0060264 A1 * 3/2014 Steele ..... H02G 1/1209 81/324

FOREIGN PATENT DOCUMENTS

JP 48951/1985 U 4/1985
JP 78568/1986 U 5/1986
JP H05-072366 U 10/1993
JP 2015-202559 A 11/2015
JP 2017-013217 A 1/2017

OTHER PUBLICATIONS

International Search Report, PCT Patent Application No. PCT/JP2016/083353, dated Jan. 24, 2017.
Written Opinion, PCT Patent Application No. PCT/JP2016/083358, dated Jan. 24, 2017.
Office Action, Japanese Patent Application No. 2015-200930, dated Oct. 4, 2016.

* cited by examiner

*Primary Examiner* — Robert J Scruggs
(74) *Attorney, Agent, or Firm* — Kilpatrick Townsend & Stockton LLP

(57) ABSTRACT

A pinching portion of needle-nose pliers is provided with pinching portion lateral width usage scale marks having widths corresponding to first integral multiples of a pitch of a universal board and pinching portion longitudinal length usage scale marks having lengths corresponding to second integral multiples not less than the first integral multiples. In accordance with this configuration, a jumper wire with a required length is obtained.

10 Claims, 14 Drawing Sheets

NEEDLE-NOSE PLIERS

TECHNICAL FIELD

The present invention relates to needle-nose pliers, and particularly, relates to needle-nose pliers capable of easily obtaining a jumper wire having a length required for the jumper wire to be used for a universal board.

BACKGROUND ART

Generally, in electronic work, frequently used is a method of disposing electronic components on a universal board called flexible board and connecting the electronic components to the universal board by jumper wires.

Such universal boards have a variety of sizes, and most of the universal boards are those in which holes (hereinafter, referred to as "through holes") are drilled at an interval of 1/10 inch (2.54 mm) in both longitudinal and lateral directions.

Then, each of the electronic components has a plurality of legs, and in most cases, an interval between these legs is an integral multiple (except for "0") of 1/10 inch.

Therefore, a person who does electronic work (hereinafter, this person will be referred to as a "worker") is capable of disposing the electronic components at arbitrary positions of the universal board.

The above-mentioned disposition of the electronic components on the universal board is determined in consideration of roles of the respective legs of the electronic components, a mutual relationship thereamong, and the like.

Then, with regard to connection of these electronic components, in many cases, the electronic components are connected to one another newly by electric wires in a separate step though the legs thereof are cut to appropriate lengths, followed by bending.

A specific procedure of creating a circuit using this universal board will be described with reference to FIG. 1(*a*) to FIG. 1(*e*). FIG. 1(*a*) illustrates a universal board 100 in which an interval between (centers of) through holes 111 is 1/10 inch (2.54 mm), and FIG. 1(*b*) illustrates disposition of a semiconductor element 112, which is an electronic component, on a front surface of the universal board 100.

The above-mentioned 1/10 inch (2.54 mm) is defined as one unit, 2/10 inch (5.08 mm) is defined as two units, 3/10 inch (7.62 mm) is defined as three units, 4/10 inch (10.16 mm) is defined as four units, 5/10 inch (12.70 mm) is defined as five units, and 6/10 inch (15.24 mm) is defined as six units. The one, two, three, four, five and six units will be respectively referred to as "pitch p1", "pitch p2", "pitch p3", "pitch p4", "pitch p5" and "pitch p6".

Moreover, FIG. 1(*c*) illustrates a back surface of the universal board 100 on which the semiconductor element 112 is disposed, FIG. 1(*d*) illustrates an electric wire drum 113 that winds an electric wire 115 (tin-plated wire or the like) therearound, and FIG. 1(*e*) illustrates a diagram in which a jumper wire 116 created by cutting and bending the electric wire 115 is connected to legs of the semiconductor element 112 and the through holes 111 on the back surface of the universal board 100.

On the front surface of the universal board 100 illustrated in FIG. 1(*a*), the legs of the semiconductor element 112 are inserted into the through holes 111 (FIG. 1(*b*)), and the legs are protruded to the back surface of the universal board 100 (FIG. 1(*c*)). Then, the electric wire 115 (tin-plated wire or the like) of the electric wire drum 113 illustrated in FIG. 1(*d*) is pulled out. The pitch p1 (1/10 inch (2.54 mm)) is too small to handle the electric wire 115 by the human fingertip, and accordingly, the electric wire 115 is bent using needle-nose pliers.

Then, by the needle-nose pliers, the electric wire 115 is cut to required lengths (pitch p1, pitch p2 . . . ), and both ends thereof are bent appropriately by the needle-nose pliers. Then, one end of the jumper wire 116 is soldered to the leg of the semiconductor element 112, and other end is soldered to the through hole 111 at an appropriate position.

In order to obtain the above-mentioned jumper wire 116, the electric wire 115 of the electric wire drum 113 must be pulled out, and a desired length thereof must be measured. For this measurement, it is common to use a ruler or the pitches Pi (p1, p2, p3, p4, p5, p6) of the universal board 100.

In the case of obtaining the jumper wire 116 with a length of the pitch p4 that is four units using the pitch Pi of the universal board 100, the electric wire 115 is caught by one hand, and a terminal end of the electric wire 115 is matched with the through hole 111 that obtains a length corresponding to the pitch p4. However, the electric wire 115 is lightweight, and accordingly, the terminal end thereof rises up or bends.

Therefore, as illustrated in FIG. 2, one side of the electric wire 115 is caught by the left hand, and the terminal end of the electric wire 115 is matched with the fifth through hole 111 counted from an end of the universal board 100, and the terminal end is then pressed by the finger of the right hand. That is, both hands are used to obtain the jumper wire with a required length.

Then, while the terminal end of the electric wire 115 is left pressed by the finger of the right hand, a portion of the universal board 100, which is near the first through hole 111 counted from the end thereof, is pressed by the finger of the left hand. Then, a pen is held by the right hand, and a position of the electric wire 115, which corresponds to a length of the pitch p4, is marked, and so on. Then, the pen is replaced by the needle-nose pliers on the right hand, the electric wire 115 is held by the left hand, and a position of the mark on the electric wire 115 is cut by the needle-nose pliers on the right hand, whereby the jumper wire 116 for a length of the pitch p4 is obtained. Then, both ends of the jumper wire 116 are bent by the needle-nose pliers according to needs (for example, by a length of the pitch p1).

As the above-mentioned needle-nose pliers, needle-nose pliers disclosed in PTL 1 described below are commonly used.

CITATION LIST

Patent Literature

PTL 1: Japanese Utility Model Laid-Open Publication No. H5-72366

SUMMARY OF INVENTION

Technical Problem

However, in the method described in PTL 1, the jumper wire 116 with a required length is determined by an interval between the through holes 111 of the universal board 100 using both hands, and the portion of the universal board 100, which is near the first through hole 111 counted from the end thereof, is pressed by the finger of the left hand in a state where the terminal end is pressed by the finger of the right hand. Then, the pen is held by the right hand, and the position of the electric wire 115, where the required length is obtained, is marked. Thereafter, the pen is replaced by the needle-nose pliers on the right hand, the electric wire 115 is held by the left hand, and the position of the mark on the electric wire 115 is cut by the needle-nose pliers on the right hand.

That is, the jumper wire 116 with a required length is obtained by a plurality of steps of pressing the electric wire by both hands, then pressing the electric wire by the finger of the right hand in a state where the electric wire is pressed by the finger of the left hand, marking such a cut position by the pen held by the right hand, and replacing the pen by the needle-nose pliers on the right hand. Therefore, it takes a lot of time (poor in efficiency).

Moreover, the obtained jumper wire is held by the left hand one more time, and both ends thereof are bent by the needle-nose pliers, and accordingly, more man-hours are required.

The present invention has been made in order to solve the above-described problem. It is an object of the present invention to obtain needle-nose pliers capable of easily obtaining the jumper wire with a required length while keeping to hold the electric wire by the left hand and keeping to hold the needle-nose pliers by the right hand.

Solution to Problem

Needle-nose pliers according to the present invention are needle-nose pliers in which a scale (Mi) for obtaining a jumper wire (116) with a required length on a board (100) provided with through holes (111) at a fixed pitch (p1) in a matrix is provided on a straight pinching portion (15) with a tapered shape in which a thickness decreases linearly and gradually toward a tip end (19). The needle-nose pliers are summarized in that the pinching portion (15) is provided with scales (Mi) by pinching portion lateral width usage scale marks (Mp) and pinching portion longitudinal length usage scale marks (Mq). The pinching portion lateral width usage scale marks (Mp) are scales formed at respective positions where respective pinching portion lateral widths (wi) which are first integral multiples (except for "0") of the pitch (p1) are obtained, the pinching portion lateral width usage scale marks (Mp) being configured to transversely pinch an electric wire (115) and to obtain a jumper wire (116) with a length that is each of the pinching portion lateral widths (wi). The pinching portion longitudinal length usage scale marks (Mq) are scales printed at respective positions from a tip end (19), the respective positions corresponding to respective longitudinal lengths (TLi) which are second integral multiples (except for "0") not less than the first integral multiples (except for "0") with respect to the pinching portion lateral widths (wi) corresponding to the pitch (p1), the pinching portion longitudinal length usage scale marks (Mq) being configured to pinch the electric wire (115) from the tip end (19) and to obtain a jumper wire (116) with a length that is each of the longitudinal lengths (TLi).

Advantageous Effects of Invention

In accordance with the present invention, the electric wire (115) is held by the left hand, the needle-nose pliers are held by the right hand, and using, as a criterion, the pinching portion lateral width usage scale mark (Mp) cut on the pinching portion (15) of the needle-nose pliers, the electric wire (115) is inserted from a side surface of the needle-nose pliers fully to the pinching portion lateral width usage scale mark (Mp), and the electric wire (115) is then bent. Just by doing the above steps, a jumper wire with a length of the integral multiple of the pitch p1 of the universal board can be obtained with ease.

Moreover, in order to obtain a jumper wire with a length of the second integral multiple not less than the first integral multiple of the pitch p1 of the universal board (100), the first integral multiple being obtained by the pinching portion lateral width usage scale mark (Mp), the electric wire (115) is held by the left hand, the needle-nose pliers are held by the right hand, and using, as a criterion, the pinching portion longitudinal length usage scale mark (Mq), the electric wire (115) is inserted and bent at the tip end (19). Just by doing the above steps, a jumper wire with a length of the second integral multiple not less than the first integral multiple can be obtained with ease.

That is, the jumper wire with a required length can be obtained easily while keeping to hold the electric wire by the left hand and keeping to hold the needle-nose pliers by the right hand.

DESCRIPTION OF EMBODIMENTS

The technical idea of the present invention can be modified in various ways within the technical scope described in the scope of claims. It should be noted that the drawings are schematic and are different from actual ones in terms of configuration and the like.

In description of embodiments, first, names and the like of respective portions of needle-nose pliers which are a holding tool for electronic components will be described with reference to FIG. 3(*a*) and FIG. 3(*b*). Moreover, in the needle-nose pliers according to the embodiments, a pinching portion to be described later is formed into a rounded tapered shape in which a thickness decreases as approaching a tip end thereof.

Figure 1A:
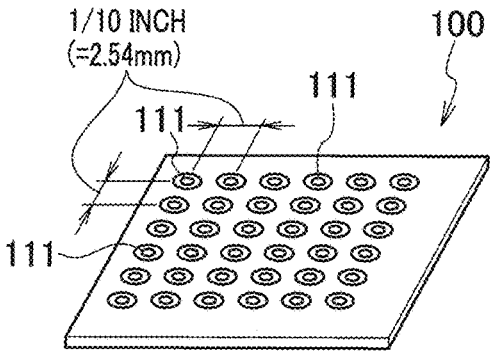
FIG. 1(*a*), FIG. 1(*b*), FIG. 1(*c*), FIG. 1(*d*) and FIG. 1(*e*) are explanatory views for explaining a specific procedure of creating a circuit using a universal board.
Figure 1B:
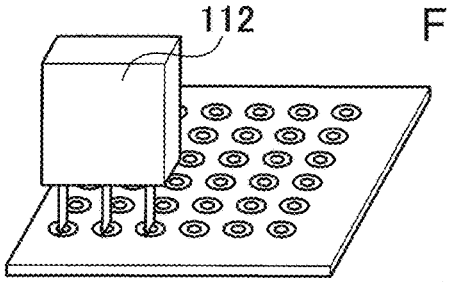
Figure 1C:
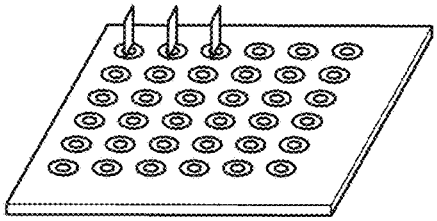
Figure 1D:
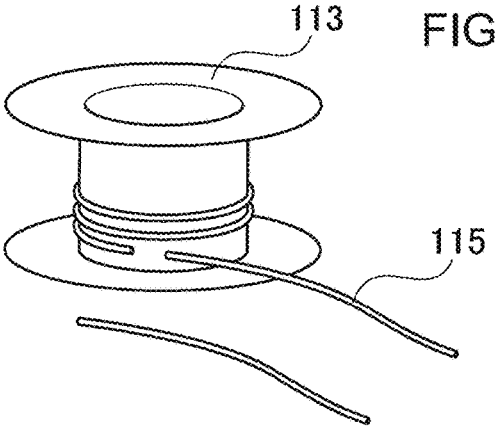
Figure 1E:
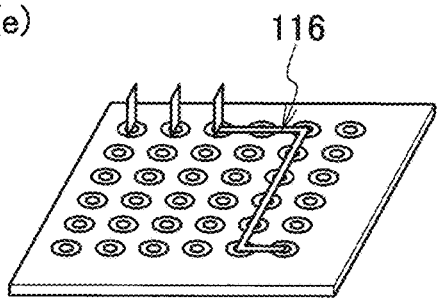
Figure 2:
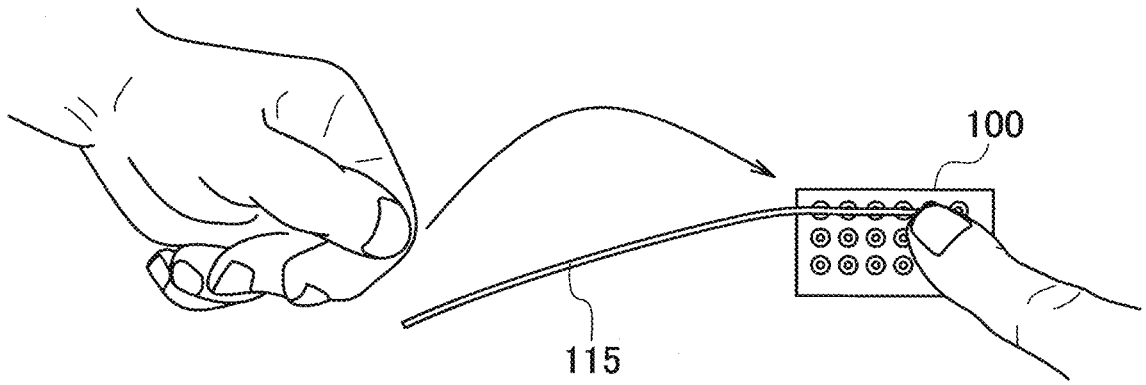
FIG. 2 is an explanatory view for explaining a procedure of a comparative example for obtaining a jumper wire with a required length.
Figure 3:
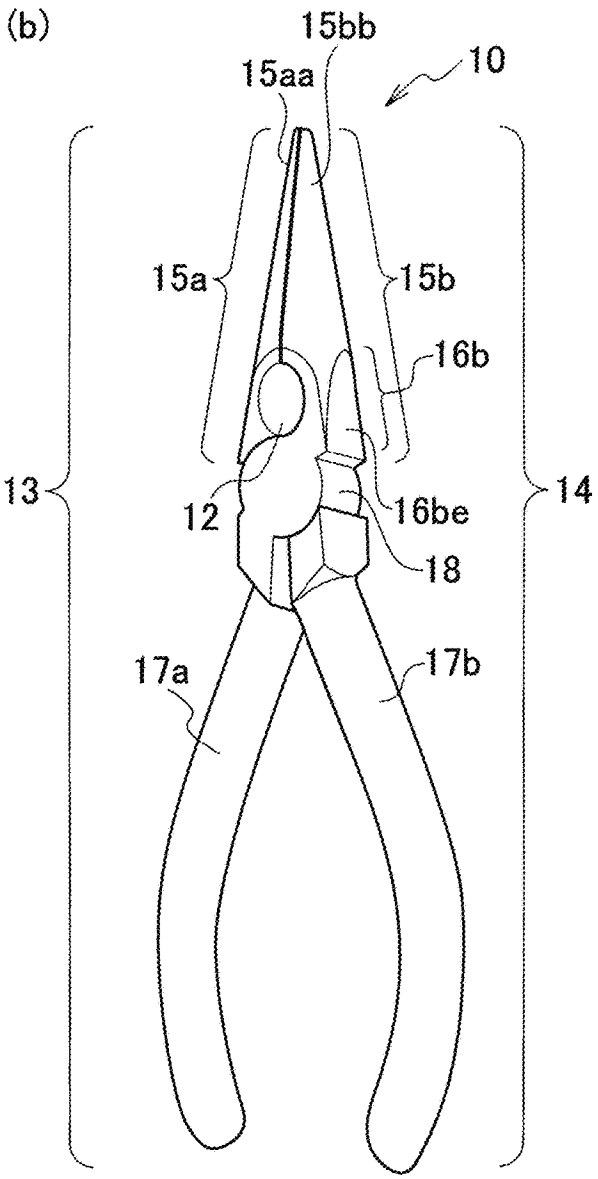
FIG. 3(*a*) and FIG. 3(*b*) are exterior views of needle-nose pliers.
Figure 3:
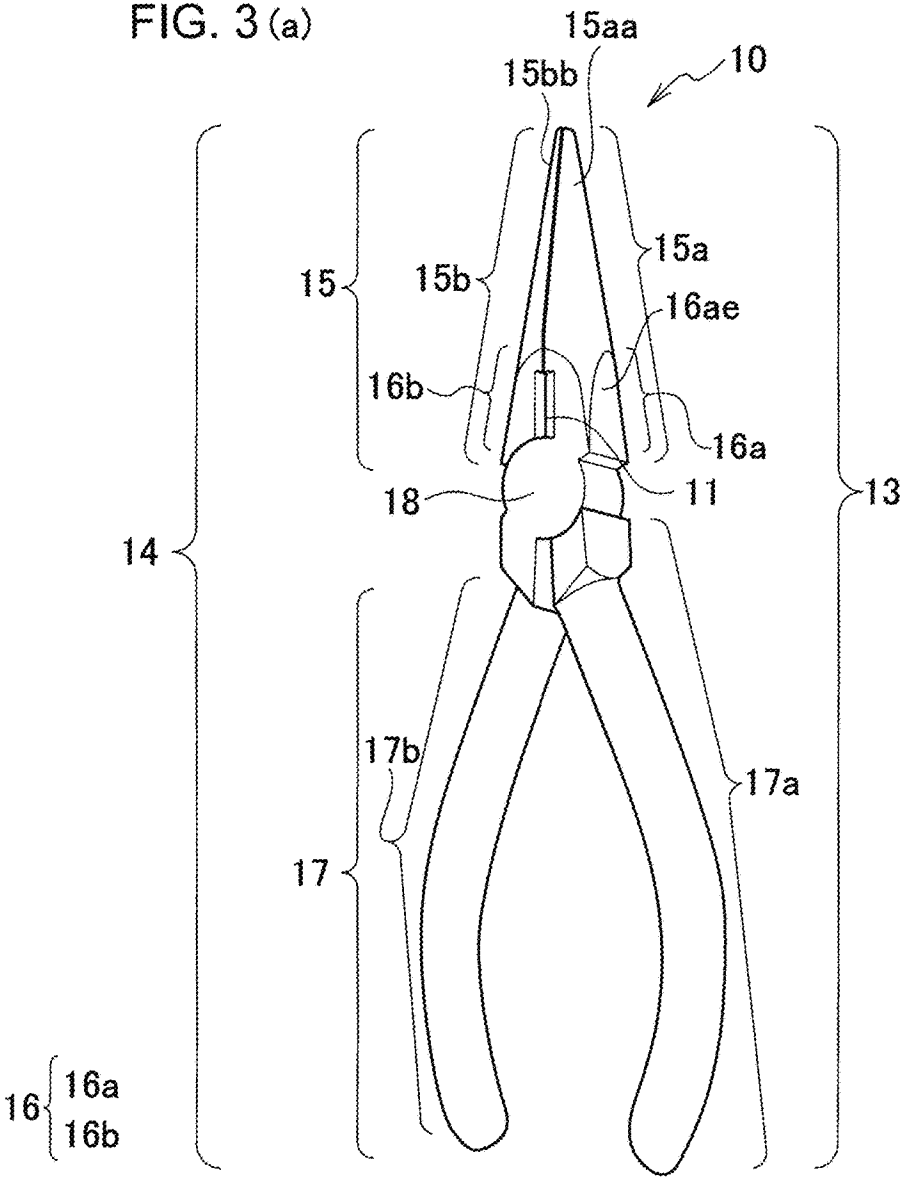

FIG. 3(*a*) is a perspective view of needle-nose pliers 10 when viewed from a cutting blade portion 11 side. FIG. 3(*b*) is a perspective view of the needle-nose pliers 10 when viewed from a cutting blade back hole 12 side.

Then, when the needle-nose pliers 10 are viewed from the cutting blade portion 11 side, then as illustrated in FIG. 3(*a*), an arm located on a right hand side of a worker will be referred to as a "right arm 13", and an arm located on a left hand side of the worker will be referred to as a "left arm 14".

Moreover, the right arm 13 is composed of a right arm pinching portion 15*a*, a right arm cutting portion 16*a*, a right arm grip portion 17*a* and the like.

Furthermore, the left arm 14 is composed of a left arm pinching portion 15*b*, a left arm cutting portion 16*b*, a hinge 18, a left arm grip portion 17*b* and the like.

The right arm pinching portion 15*a* and the left arm pinching portion 15*b*, which are mentioned above, will be collectively referred to as a "pinching portion 15", the right arm cutting portion 16*a* and the left arm cutting portion 16*b*, which are mentioned above, will be collectively referred to as a "cutting portion 16", and the right arm grip portion 17*a* and the left arm grip portion 17*b*, which are mentioned above, will be collectively referred to as a "grip portion 17".

This right arm grip portion 17*a* is integrated with the left arm pinching portion 15*b* with the hinge 18 interposed therebetween, and this left arm grip portion 17*b* is integrated with the right arm pinching portion 15*a* with the hinge 18 interposed therebetween.

Moreover, a tapered surface of the right arm pinching portion 15*a* will be referred to as a "right arm pinching portion tapered surface 15*aa*", and a tapered surface of the left arm pinching portion 15*b* will be referred to as a "left arm pinching portion tapered surface 15*bb*".

Furthermore, a flat portion of the right arm cutting portion 16*a*, which is located behind the right arm pinching portion tapered surface 15*aa* of the right arm pinching portion 15*a*, will be referred to as a "right cutting portion upper surface 16*ae*", and a flat portion of the left arm cutting portion 16*b*, which is located behind the left arm pinching portion tapered surface 15*bb* of the left arm pinching portion 15*b*, will be referred to as a "left cutting portion upper surface 16*be*". This right cutting portion upper surface 16*ae* and this left cutting portion upper surface 16*be* will be collectively referred to as a "cutting portion upper surface 16*e*".

First Embodiment

Hereinafter, needle-nose pliers according to a first embodiment will be described. In the first embodiment, the pinching portion 15 is provided with electric wire length measuring scales Mi composed of pinching portion lateral width usage scale marks Mp (Mp1, Mp2, Mp3) and pinching portion longitudinal length usage scale marks Mq (Mq4, Mq5, Mq6), which will be described later. Accordingly, the needle-nose pliers according to the first embodiment will be referred to as "pinching portion electric wire length measuring scale-added needle-nose pliers 30".

Figure 4:
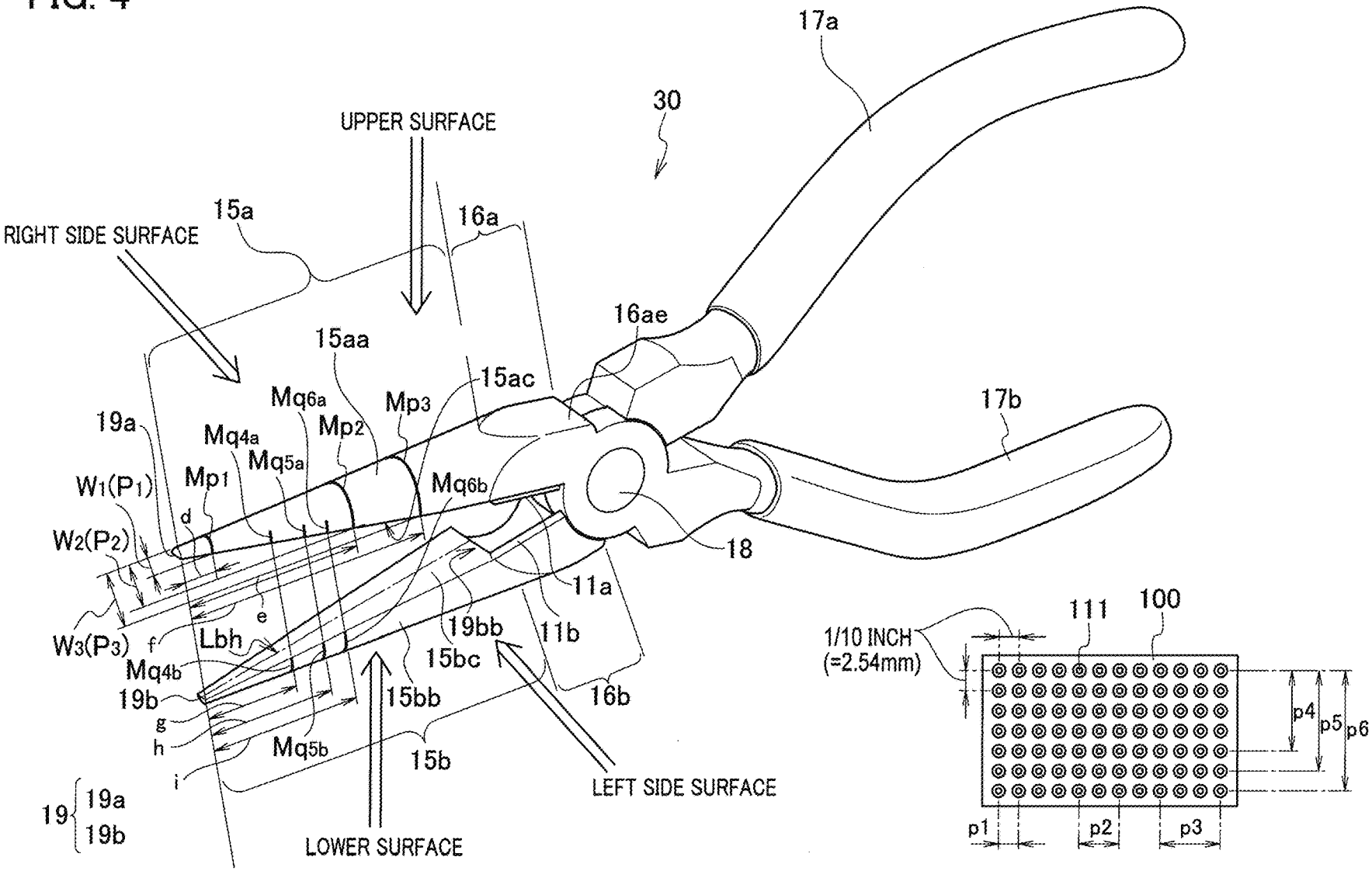
FIG. 4 is a perspective view of pinching portion electric wire length measuring scale-added needle-nose pliers 30 according to a first embodiment.

FIG. 4 is a perspective view of the pinching portion electric wire length measuring scale-added needle-nose pliers 30 according to the first embodiment. In FIG. 4, the pinching portion electric wire length measuring scale-added needle-nose pliers 30 will be described while illustrating the universal board 100.

That is, FIG. 4 illustrates the pinching portion electric wire length measuring scale-added needle-nose pliers 30 in which the scales Mi for obtaining the jumper wire 116 with a required length on the universal board 100 provided with the through holes 111 at an interval (for example, 1/10 inch) of the fixed pitch p1 in a matrix are provided on the straight pinching portion 15 with a tapered shape in which a thickness decreases linearly and gradually toward a tip end 19.

The pinching portion electric wire length measuring scale-added needle-nose pliers 30 according to the first embodiment can cope with "right-handed" and "left-handed"; however, will be described below on the assumption that a user thereof is a "right-handed" worker.

In FIG. 4, the cutting blade portion 11 (right cutting blade 11*a*, left cutting blade 11*b*) of the cutting portion 16 provided behind the pinching portion 15 (15*a*, 15*b*) faces front.

That is, when the "right-handed" worker holds, by the right hand, the grip portion 17 of the pinching portion electric wire length measuring scale-added needle-nose pliers 30, then the "cutting blade portion 11" side faces left, and accordingly, a surface thereof in a direction where this "cutting blade portion 11" side is viewed will be referred to as a "left side surface", and a surface thereof in an opposite direction will be referred to as a "right side surface".

Moreover, when the "right-handed" worker holds, by the right hand, the grip portion 17 of the pinching portion electric wire length measuring scale-added needle-nose pliers 30, a surface of the pinching portion electric wire length measuring scale-added needle-nose pliers 30 when viewed from above will be referred to as an "upper surface", and a surface thereof when viewed from below will be referred to as a "lower surface".

Moreover, flat surfaces of the right arm pinching portion 15*a* and the left arm pinching portion 15*b*, which pinch a tin-plated wire, an electronic component or the like, will be referred to as "pinching surfaces", the pinching surface of the right arm pinching portion 15*a* will be referred to as a "right arm pinching portion flat surface portion 15*ac*", and the pinching surface of the left arm pinching portion 15*b* facing the right arm pinching portion flat surface portion 15*ac* will be referred to as a "left arm pinching portion flat surface portion 15*bc*". The electronic component, the electric wire 115 or the like, which is a pinching target, is pinched by the right arm pinching portion flat surface portion 15*ac* and the left arm pinching portion flat surface portion 15*bc*.

Then, as illustrated in FIG. 4, the scales Mi are formed from the tip end 19 toward the rear on the right arm pinching portion tapered surface 15*aa* of the right arm pinching portion 15*a* of the right arm 13 and on the left arm pinching portion tapered surface 15*bb* of the left arm pinching portion 15*b*.

This tip end 19 is tip ends of the right arm pinching portion flat surface portion 15*ac* and of the left arm pinching portion flat surface portion 15*bc*, and a right arm pinching portion 15*a* side thereof will be referred to as a "right arm pinching portion flat surface portion tip end 19*a*", and a left arm pinching portion 15*b* side thereof will be referred to as a "left arm pinching portion flat surface portion tip end 19*b*".

Moreover, a rear end of the right arm pinching portion flat surface portion 15*ac*, which is adjacent to the right cutting blade 11*a*, will be referred to as a "right arm pinching portion flat surface rear end 19*aa*" (not illustrated), and a rear end of the left arm pinching portion flat surface portion 15*bc*, which is adjacent to the left cutting blade 11*b*, will be referred to as a "left arm pinching portion flat surface rear end 19*bb*".

Then, a centerline that passes from the center of the right arm pinching portion flat surface portion tip end 19*a* through the center of the right arm pinching portion flat surface rear end 19*aa* (not illustrated) will be referred to as a "right arm pinching portion centerline Lah" (not illustrated).

Moreover, a centerline that passes from the center of the left arm pinching portion flat surface portion tip end 19*b* through the center of the left arm pinching portion flat surface rear end 19*bb* will be referred to as a "left arm pinching portion centerline Lbh". The right arm pinching portion centerline Lah and the left arm pinching portion centerline Lbh will be collectively referred to as a "pinching portion flat surface centerline Lh". In FIG. 4, only the left arm pinching portion centerline Lbh is illustrated as the pinching portion flat surface centerline Lh.

The pinching portion lateral width usage scale marks Mp are composed of a first scale mark Mp1, a second scale mark Mp2 and a third scale mark Mp3, which serve as scales for measuring the length of the electric wire 115. The pinching portion longitudinal length usage scale marks Mq is composed of a fourth scale mark Mq4, a fifth scale mark Mq5, and a sixth scale mark Mq6. These may be linear lines or circular markers, which are written by indelible ink or the like; however, preferably, are formed of grooves with a diameter that is approximately a half of a diameter of the electric wire 115.

Note that the first scale mark Mp1, the second scale mark Mp2 and the third scale mark Mp3 may be provided on both or either of the right arm pinching portion tapered surface 15*aa* and the left arm pinching portion tapered surface 15*bb*; however, in the first embodiment, are described on the assumption of being provided on the right arm pinching portion tapered surface 15*aa*.

Moreover, the fourth scale mark Mq4, the fifth scale mark Mq5 and the sixth scale mark Mq6 may be provided on both or either of the right arm pinching portion tapered surface 15*aa* and the left arm pinching portion tapered surface 15*bb*; however, in the first embodiment, are described on the assumption of being provided on both of the right arm pinching portion tapered surface 15*aa* and the left arm pinching portion tapered surface 15*bb*.

The fourth scale mark Mq4, the fifth scale mark Mq5 and the sixth scale mark Mq6, which are the pinching portion longitudinal length usage scale marks Mq, are formed shorter than the pinching portion lateral width usage scale marks Mp and are painted with a color different from that of the pinching portion lateral width usage scale marks Mp in order to be distinguished therefrom.

Then, the fourth scale mark Mq4 provided on the right arm pinching portion tapered surface 15*aa* will also be referred to as a "right arm pinching portion tapered surface fourth scale mark Mq4*a*", the fifth scale mark Mq5 provided thereon will also be referred to as a "right arm pinching portion tapered surface fifth scale mark Mq5*a*", and the sixth scale mark Mq6 provided thereon will also be referred to as a "right arm pinching portion tapered surface sixth scale mark Mq6*a*". Meanwhile, the fourth scale mark Mq4 provided on the left arm pinching portion tapered surface 15*bb* will also be referred to as a "left arm pinching portion tapered surface fourth scale mark Mq4*b*", the fifth scale mark Mq5 provided thereon will also be referred to as a "left arm pinching portion tapered surface fifth scale mark Mq5*b*", and the sixth scale mark Mq6 provided thereon will also be referred to as a "left arm pinching portion tapered surface sixth scale mark Mq6*b*".

In order to create the jumper wire 116 for use in the universal board 100 provided with the through holes 111 at an interval (for example, 1/10 inch) of the fixed pitch p1 in a matrix, in accordance with the pinching portion electric wire length measuring scale-added needle-nose pliers 30, the jumper wire 116 with a length of an integral multiple (except for "0") of the pitch p1 can be easily obtained while the electric wire 115 is left held by the left hand and the grip portion 17 is left gripped by the right hand.

[Determination of Positions of Scales Mi by Pitches Pi]

Positions of the scales Mi (Mp1, Mp2 . . . , Mq6) correspond to the pitches pi (p1, p2 . . . , p6) as integral multiples (except for "0": 1, 2 . . . , 6) of the pitch p1 (1/10 inch (2.54 mm)) that is a fixed interval between the through holes 111 of the universal board 100 illustrated in FIG. 4.

For forming the first scale mark Mp1, by vernier calipers and the like, found is a lateral width on the right arm pinching portion tapered surface 15*aa* (or the right arm pinching portion flat surface portion 15*ac*) corresponding to (coinciding with) the interval of the pitch p1 (1/10 inch (2.54 mm)) of the universal board 100. Hereinafter, this lateral width will be referred to as a "pitch p1-corresponding lateral width w1".

Then, on the pinching portion flat surface centerline Lh (Lah or Lbh), a position where the pitch p1-corresponding lateral width w1 is obtained is determined. Hereinafter, this position will be referred to as a "pitch p1-corresponding pinching portion lateral width usage scale mark position Mdp1" (not illustrated). Then, a groove is cut around a whole circumference (or a partial circumference) of the right arm pinching portion tapered surface 15*aa* (that is, the surface of the right arm pinching portion 15*a*) corresponding to this pitch p1-corresponding pinching portion lateral width usage scale mark position Mdp1, whereby the first scale mark Mp1 is formed. That is, a groove is formed around a circumference of the right arm pinching portion tapered surface 15*aa* so as to pass through a perpendicular line (not illustrated) on the pitch p1-corresponding pinching portion lateral width usage scale mark position Mdp1, the perpendicular line being perpendicular to the pinching portion flat surface centerline Lh (Lah or Lbh).

For forming the second scale mark Mp2, by vernier calipers and the like, found is a lateral width on the right arm pinching portion tapered surface 15*aa* (or the right arm pinching portion flat surface portion 15*ac*) corresponding to (coinciding with) the interval of the pitch p2 (2/10 inch (5.08 mm)) of the universal board 100. Hereinafter, this lateral width will be referred to as a "pitch p2-corresponding lateral width w2". Then, on the pinching portion flat surface centerline Lh (Lah or Lbh), a position where the pitch p2-corresponding lateral width w2 is obtained is determined. Hereinafter, this position will be referred to as a "pitch p2-corresponding pinching portion lateral width usage scale mark position Mdp2" (not illustrated).

Then, a groove is cut around a whole circumference (or a partial circumference) of the right arm pinching portion tapered surface 15*aa* (that is, the surface of the right arm pinching portion 15*a*) corresponding to this pitch p2-corresponding pinching portion lateral width usage scale mark position Mdp2, whereby the second scale mark Mp2 is formed. That is, a groove is formed around a circumference of the right arm pinching portion tapered surface 15*aa* so as to pass through a perpendicular line (not illustrated) on the pitch p2-corresponding pinching portion lateral width usage scale mark position Mdp2, the perpendicular line being perpendicular to the pinching portion flat surface centerline Lh (Lah or Lbh).

For forming the third scale mark Mp3, by vernier calipers and the like, found is a lateral width on the right arm pinching portion tapered surface 15*aa* (or the right arm pinching portion flat surface portion 15*ac*) corresponding to a lateral width on the right arm pinching portion tapered surface 15*aa* (or the right arm pinching portion flat surface portion 15*ac*), the lateral width corresponding to the interval of the pitch p3 (3/10 inch (7.62 mm)) of the universal board 100. Hereinafter, this lateral width will be referred to as a "pitch p3-corresponding lateral width w3".

Then, on the pinching portion flat surface centerline Lh (Lah or Lbh), a position where the pitch p3-corresponding lateral width w3 is obtained is determined. Hereinafter, this position will be referred to as a "pitch p3-corresponding pinching portion lateral width usage scale mark position Mdp3" (not illustrated). Then, a groove is cut around a whole circumference (or a partial circumference) of the right arm pinching portion tapered surface 15*aa* (that is, the surface of the right arm pinching portion 15*a*) corresponding to this pitch p3-corresponding pinching portion lateral width usage scale mark position Mdp3, whereby the third scale mark Mp3 is formed. That is, a groove is formed around a circumference of the right arm pinching portion tapered surface 15*aa* so as to pass through a perpendicular line (not illustrated) on the pitch p3-corresponding pinching portion lateral width usage scale mark position Mdp3, the perpendicular line being perpendicular to the pinching portion flat surface centerline Lh (Lah or Lbh).

The pitch p1-corresponding lateral width w1, the pitch p2-corresponding lateral width w2 and the pitch p3-corresponding lateral width w3, which are mentioned above, will be collectively referred to as "pinching portion lateral widths wi".

Moreover, the pitch p1-corresponding pinching portion lateral width usage scale mark position Mdp1, the pitch p2-corresponding pinching portion lateral width usage scale mark position Mdp2, and the pitch p3-corresponding pinching portion lateral width usage scale mark position Mdp3 will be collectively referred to as "pinching portion lateral width usage scale mark positions Mdpi". Moreover, integral multiples (1, 2, 3: except for "0") for obtaining the pitch p1-corresponding lateral width w1, the pitch p2-corresponding lateral width w2 and the pitch p3-corresponding lateral width w3 are also referred to as "first integral multiples".

For forming a groove of the fourth scale mark Mq4, the interval of the pitch p4 (4/10 inch (10.16 mm)) of the universal board 100 is measured by vernier calipers or the like, and from the left arm pinching portion flat surface portion tip end 19*b*, positions on side surfaces of the right arm pinching portion tapered surface 15*aa* and the left arm pinching portion tapered surface 15*bb* at a pitch-p4 longitudinal length "g" corresponding to the above-described interval are found. Then, at the positions, grooves are formed on the circumferences of the right arm pinching portion tapered surface 15*aa* and the left arm pinching portion tapered surface 15*bb* so as to be perpendicular to the pinching portion flat surface centerline Lh (Lah or Lbh). In this way, Mq4*a* and Mq4*b* are formed.

For forming a groove of the fifth scale mark Mq5, the interval of the pitch p5 (5/10 inch (12.70 mm)) of the universal board 100 is measured by vernier calipers or the like, and from the left arm pinching portion flat surface portion tip end 19*b*, positions on side surfaces of the right arm pinching portion tapered surface 15*aa* and the left arm pinching portion tapered surface 15*bb* at a pitch-p5 longitudinal length "h" corresponding to the above-described interval are found. Then, at the positions, grooves are formed on the circumferences of the right arm pinching portion tapered surface 15*aa* and the left arm pinching portion tapered surface 15*bb* so as to be perpendicular to the pinching portion flat surface centerline Lh (Lah or Lbh). In this way, Mq5*a* and Mq5*b* are formed.

For forming a groove of the sixth scale mark Mq6, the interval of the pitch p6 (6/10 inch (15.24 mm)) of the universal board 100 is measured by vernier calipers or the like, and from the left arm pinching portion flat surface portion tip end 19*b*, positions on side surfaces of the right arm pinching portion tapered surface 15*aa* and the left arm pinching portion tapered surface 15*bb* at a pitch-p6 longitudinal length "i" corresponding to the above-described interval are found. Then; at the positions, grooves are formed on the circumferences of the right arm pinching portion tapered surface 15*aa* and the left arm pinching portion tapered surface 15*bb* so as to be perpendicular to the pinching portion flat surface centerline Lh (Lah or Lbh) In this way, Mq6*a* and Mq6*b* are formed.

Integral multiples (4, 5, 6: except for "0") for obtaining the pitch-p4 longitudinal length "g", the pitch-p5 longitudinal length "h" and the pitch-p6 longitudinal length (i), which are mentioned above, are also referred to as "second integral multiples" (no less than the first integral multiples).

Moreover, the position where the pitch-p4 longitudinal length "g" is measured, the position where the pitch-p5 longitudinal length "h" is measured, and the position where the pitch-p6 longitudinal length "i" will be referred to as "pinching portion longitudinal length usage scale mark positions Mdqi".

These first scale mark Mp1, second scale mark Mpg and third scale mark Mp3 and fourth scale mark Mq4, fifth scale mark Mq5 and sixth scale mark Mq6 are grooves formed by a drill with a dimension of approximately a half of a diameter (0.2 to 0.5 mm dia.) of the electric wire 115, and are painted with a color such as red and black.

Figure 5A:
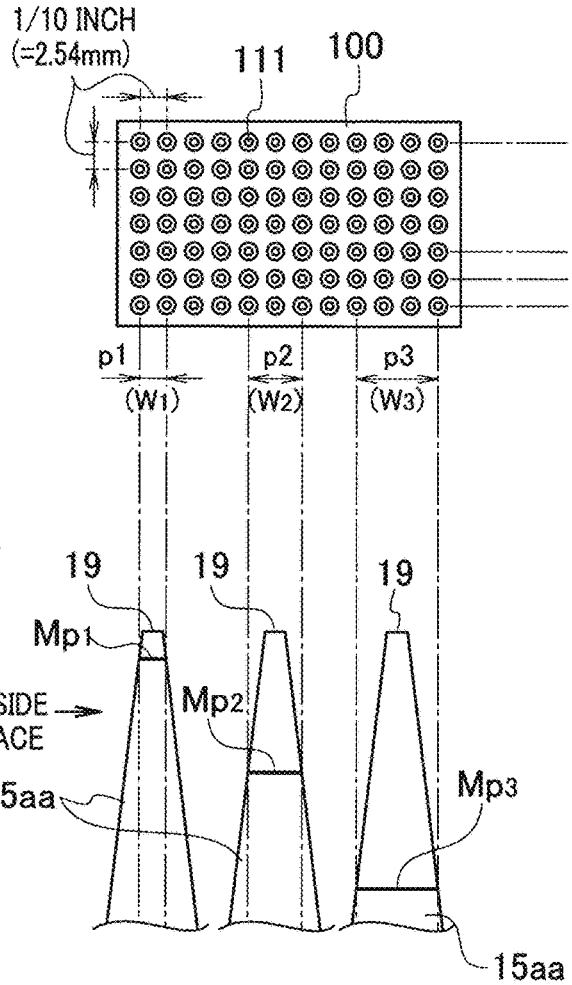
FIG. 5(*a*), FIG. 5(*b*) and FIG. 5(*c*) are explanatory views of determination of positions of scales Mi by pitches pi.
Figure 5C:
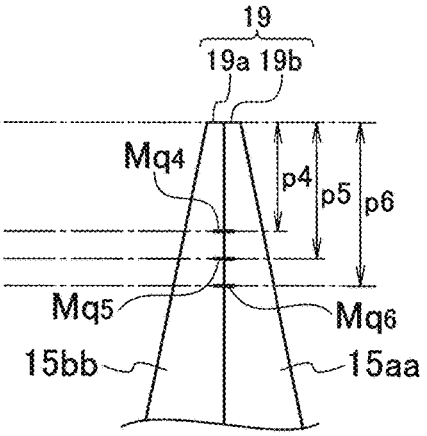
Figure 5B:
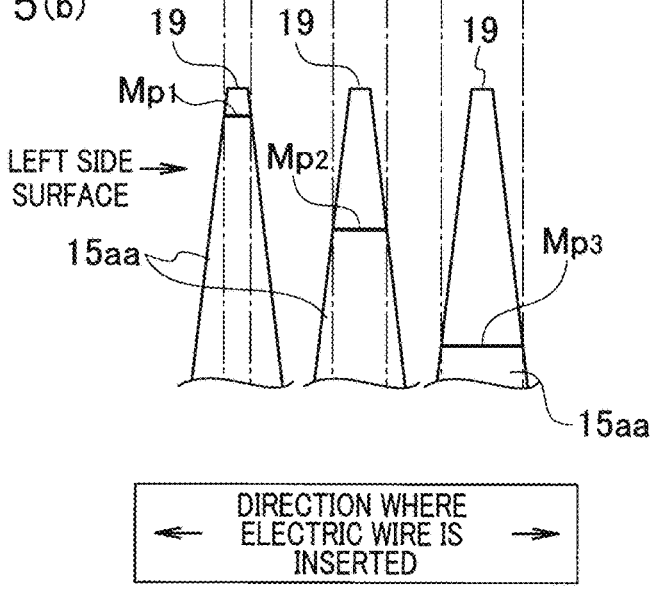

That is, the scales Mi of the pinching portion electric wire length measuring scale-added needle-nose pliers 30 and the pitch pi of the universal board 100 have a relationship illustrated in FIG. 5(*a*) to FIG. 5(*c*).

FIG. 5(*a*) illustrates the universal board 100 in which the through holes 111 are formed at an interval of 1/10 inch (2.54 mm).

In FIG. 5(*a*) to FIG. 5(*c*), the "pitch P1", the "pitch P2", the "pitch P3", the pitch P4", the "pitch P5" and the "pitch P6", which are the integral multiples, are denoted by reference symbols "P1" to "P6".

Moreover, on a left end of FIG. 5(*b*), the first scale mark Mp1 on the upper surface of the right arm pinching portion 15*a* is illustrated, on a center of FIG. 5(*b*), the second scale mark Mp2 on the upper surface of the right arm pinching portion 15*a* is illustrated, and on a right end, the third scale mark Mp3 is illustrated.

Moreover, FIG. 5(*c*) illustrates a left side surface of FIG. 5(*a*). FIG. 5(*c*) illustrates the fourth scale mark Mq4 (Mq4*a*, Mq4*b*), the fifth scale mark Mq5 (Mq5*a*, Mq5*b*), and the sixth scale mark Mq6 (Mq6*a*, Mq6*b*).

That is, as illustrated in FIG. 5(*b*), the pitch P1 (1/10 inch: 2.54 mm) of the universal board 100 corresponds to the first scale mark Mp1, the pitch P2 (2/10 inch: 5.08 mm) thereof corresponds to the second scale mark Mp2, and the pitch p3 (3/10 inch: 7.62 mm) thereof corresponds to the third scale mark Mp3.

Moreover, as illustrated in FIG. 5(*c*), the pitch P4 (4/10 inch: 10.16 mm) corresponds to the fourth scale mark Mq4, the pitch P5 (5/10 inch: 12.70 mm) corresponds to the fifth scale mark Mq5, and the pitch p6 (6/10 inch: 15.24 mm) corresponds to the sixth scale mark Mq6.

Positions of Scales Mi from Tip End 19

For the positions of the scales Mi, lengths thereof from the tip end 19 may be measured, and the scales Mi may be formed at such position thus measured. The above will be described below with reference to FIG. 6(*a*) and FIG. 6(*b*).

Figure 6:
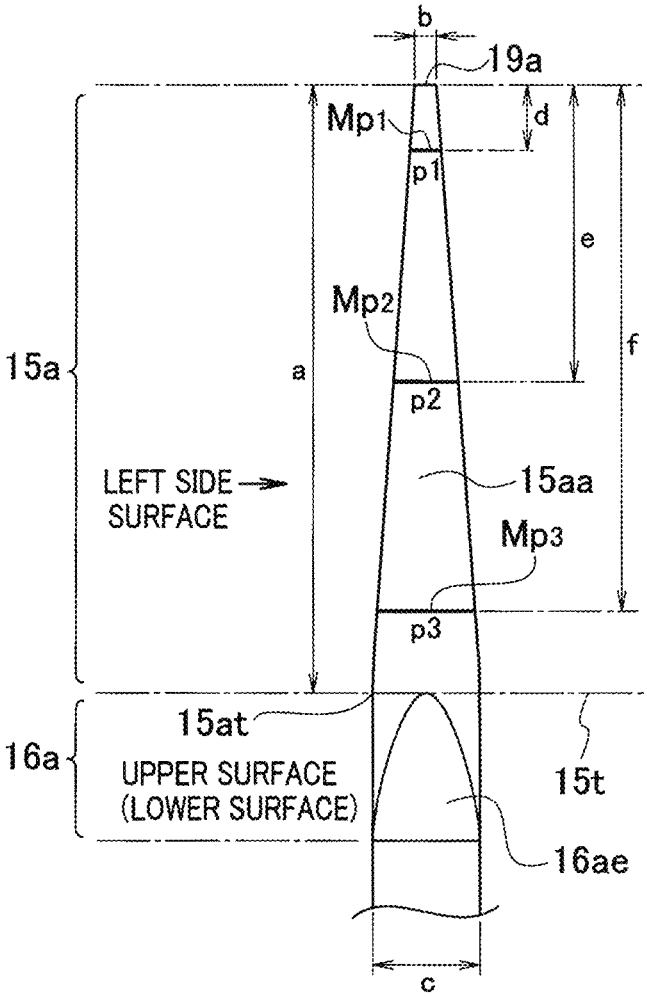
FIG. 6(*a*) and FIG. 6(*b*) are explanatory views of determination of the positions of the scales Mi from a tip end 19.
Figure 6:
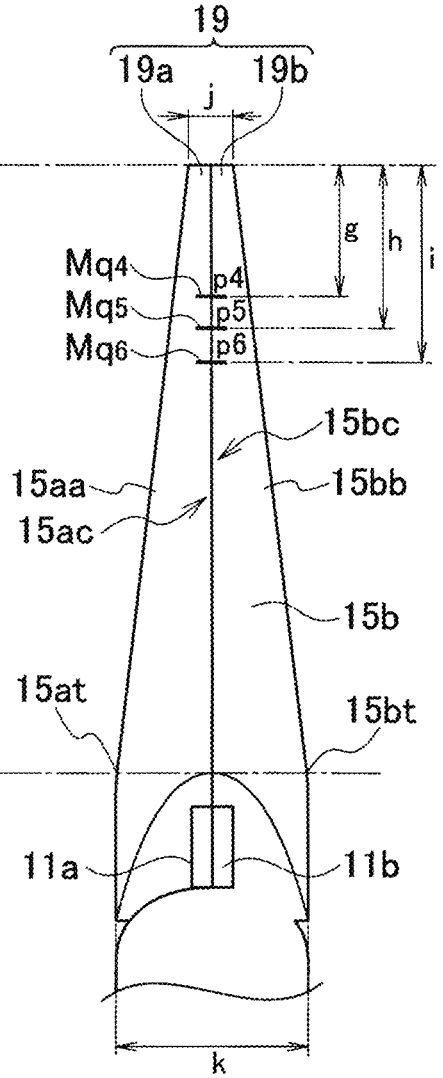

FIG. 6(*a*) illustrates the pinching portion electric wire length measuring scale-added needle-nose pliers 30 when the right arm 13 thereof is viewed from above (or below). However, FIG. 6(*a*) illustrates the right arm pinching portion 15*a* and the right cutting portion upper surface 16*ae* of the right arm cutting portion 16*a*.

Moreover, FIG. 6(*a*) illustrates a tip end of the right arm pinching portion tapered surface 15*aa* of the right arm pinching portion 15*a*, which is adjacent to the right cutting portion upper surface 16*ae*, as a right pinching portion tapered surface start position 15*at*. (A similar tip end on the left side is a left pinching portion tapered surface start position 15*bt*). The right pinching portion tapered surface start position 15*at* and the left side is a left pinching portion tapered surface start position 15*bt* will be collectively referred to as a "tapered surface start position 15*t*".

FIG. 6(*b*) illustrates a left side view when the pinching portion electric wire length measuring scale-added needle-nose pliers 30 in FIG. 6(*a*) is viewed from the left side surface.

As illustrated in FIG. 6(*a*), preferably, on the first scale mark Mp1, a symbol "p1" indicating that a position thereof corresponds to the length of the pitch p1 (1/10 inch (2.54 mm)) is printed, on the second scale mark Mpg, a symbol "p2" indicating that a position thereof corresponds to the length of the pitch p2 (2/10 inch (5.08 mm)) is printed, and on the third scale mark Mp3, a symbol "p3" indicating that a position thereof corresponds to the length of the pitch p3 (3/10 inch (7.62 mm)) is printed.

Moreover, as illustrated in FIG. 6(*b*), preferably, on the fourth scale mark Mq4, a symbol "p4" indicating that a position thereof corresponds to the length of the pitch p4 (4/10 inch (10.16 mm)) is printed, on the fifth scale mark Mq5, a symbol "p5" indicating that a position thereof corresponds to the length of the pitch p5 (5/10 inch (12.70 mm)) is printed, and on the sixth scale mark Mq6, a symbol "p6" indicating that a position thereof corresponds to the length of the pitch p6 (6/10 inch (15.24 mm)) is printed.

Moreover, FIG. 6(*b*) illustrates a height of the tip end 19 (hereinafter, this height will be referred to as a "tip end height j"), and illustrates a height of the cutting portion 16 (hereinafter, this height will be referred to as a "cutting height k"). This cutting height k is also a maximum cross section of the pinching portion 15.

Then, as illustrated in FIG. 6(*b*), each of the right arm pinching portion tapered surface 15*aa* of the right arm pinching portion 15*a* and the left arm pinching portion tapered surface 15*bb* of the left arm pinching portion 15*b* in the pinching portion 15 is formed into a tapered shape in which a thickness is reduced linearly and gradually from each of the right pinching portion tapered surface start position 15*at* and the left pinching portion tapered surface start position 15*bt* and this thickness reduction reaches the tip end 19.

When such a tapered surface in which a thickness is reduced linearly and gradually toward a tip end is provided, positions graduated by scales of lengths corresponding to the first scale mark Mp1 (pitch p1) to the third scale mark Mp3 (pitch p3), which are described above, depend on a gradient of the tapered surface.

That is, a length of the right arm pinching portion flat surface portion 15*ac* or the left arm pinching portion flat surface portion 15*bc* is defined as a "longitudinal length a" (tapered surface interval), a width of the tip end 19 is defined as a "tip end lateral width b", and a lateral width of the right arm pinching portion upper surface f5*ae* and the left arm pinching portion upper surface 15*be* is defined as a "pinching portion upper surface maximum width c".

Moreover, when lengths to the pinching portion lateral width usage scale marks Mdpi, which are the positions of the first scale mark Mp1, the second scale mark Mp2 and the third scale mark Mp3 for obtaining the pitch p1 to the pitch p3, are respectively defined as "d", "e" and "f" from the tip end 19, these "d", "e" and "f" as longitudinal lengths TLi can be obtained by the following equations. Here, a unit is mm.

"d" as the longitudinal length TLi from the tip end 19 to the first scale mark Mp1 can be obtained as follows:

$$d=a\times(2.54-b)/(c-b)\ \text{(mm)} \qquad \text{Equation 1}$$

(where 2.54 is the pitch p1)

"e" as the longitudinal length TLi from the tip end 19 to the second scale mark Mp2 can be obtained as follows:

$$e=a\times(5.08-b)/(c-b)\ \text{(mm)} \qquad \text{Equation 2}$$

(where 5.08 is the pitch p 2)

"f" as the longitudinal length TLi from the tip end 19 to the third scale mark Mp3 can be obtained as follows:

$$f=a\times(7.62-b)/(c-b)\ \text{(mm)} \qquad \text{Equation 3}$$

(where 7.62 is the pitch p3).

Meanwhile, when longitudinal lengths TLi from the tip end 19 to the fourth scale mark Mq4 (pitch p4), the fifth scale mark Mq5 (pitch p5) and the sixth scale mark Mq6 (pitch p6) are respectively defined as "g", "h" and "i", these longitudinal lengths can be obtained by the following equations. Here, a unit is mm.

"g" as the longitudinal length TLi from the tip end 19 to the fourth scale mark Mq4 is determined as follows:

$$g=10.16\ \text{(mm)} \qquad \text{Equation 4}$$

(where 10.16 is the pitch p4).

"h" as the longitudinal length TLi from the tip end 19 to the fifth scale mark Mq5 is determined as follows:

$$h=12.70\ \text{(mm)} \qquad \text{Equation 5}$$

(where 12.70 is the pitch p5).

"i" as the longitudinal length TLi from the tip end 19 to the sixth scale mark Mq6 is determined as follows:

$$i=15.24\ \text{(mm)} \qquad \text{Equation 6}$$

(where 15.24 is the pitch p6).

That is, the fourth scale mark Mq4 to the sixth scale mark Mq6 are determined using these Equation 4 to Equation 6, which are values determined by measuring the pitches of the universal board 100.

When the positions of the scales Mi are determined using the above-described Equations 1 to 6 and using, for example, needle-nose pliers of a type in which an overall length is 150.0 mm, an overall width is 52.0 mm, "a" is 47.8 mm, "b" is 1.8 mm, and "c" is 8.5 mm, the determined positions are as illustrated in Table 1.

TABLE 1

CALCULATION EXAMPLE OF SCALE POSITION

| Item | | | Dimension mm |
|---|---|---|---|
| Overall length | | | 150.0 |
| Overall width | | | 52.0 |
| Tapered surface interval | | a | 47.8 |
| Tip end width | | b | 1.8 |
| | | c | 8.5 |
| Position of Mi | Upper surface (lower surface) | Mp1 (pitch1) d | 5.28 |
| | | Mp2(pitch2) e | 23.40 |
| | | Mp3(pitch3) f | 41.52 |
| | Left side surface (right side surface) | Mq4(pitch4) g | 10.16 |
| | | Mq5(pitch5) h | 12.70 |
| | | Mq6(pitch6) i | 15.24 |
| j | | | 2.1 |
| k | | | 13.1 |

Method of Use

Figure 7:
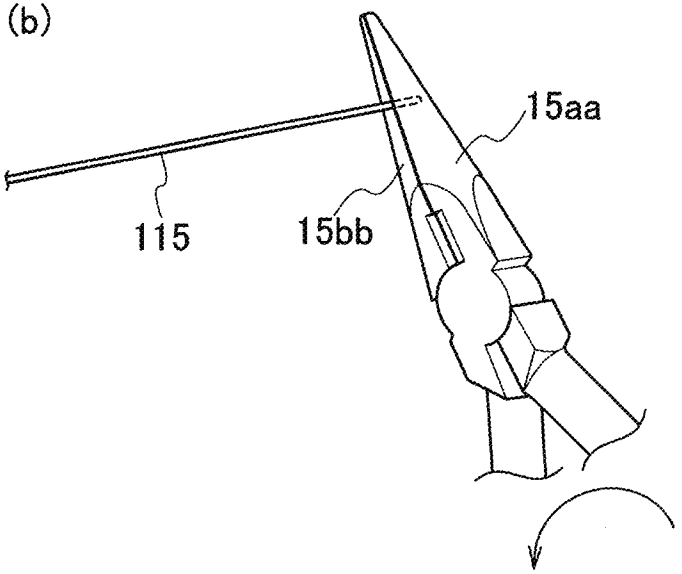
FIG. 7(*a*), FIG. 7(*b*), FIG. 7(*c*) and FIG. 7(*d*) are explanatory views of usage modes of a first scale mark Mp1, a second scale mark Mpg and a third scale mark Mp3.
Figure 7:
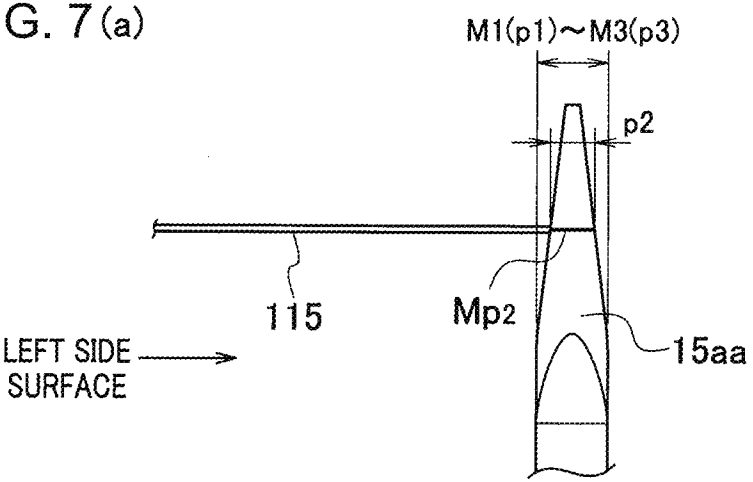
Figure 7:
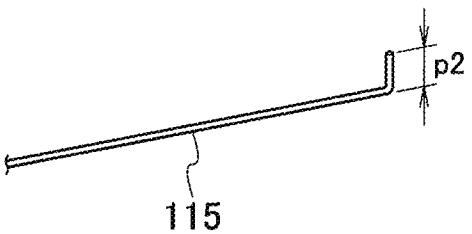
Figure 7:
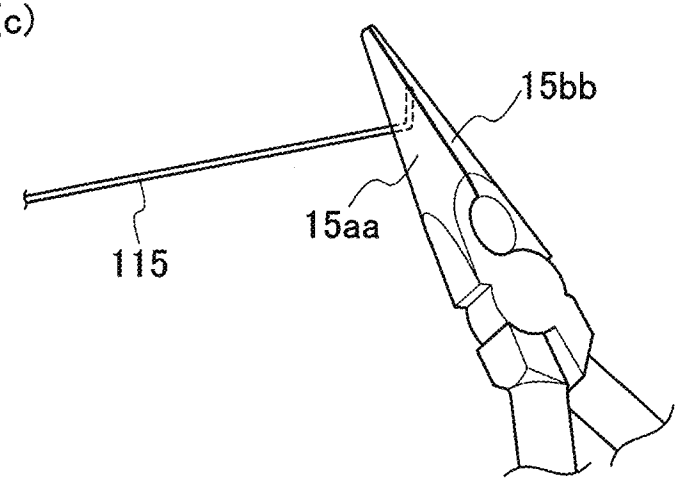
Figure 8A:
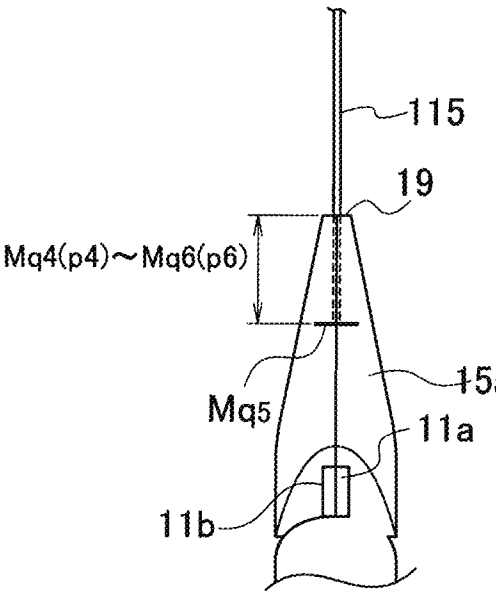
FIG. 8(*a*), FIG. 8(*b*), FIG. 8(*c*) and FIG. 8(*d*) are explanatory views for explaining usage modes of a fourth scale mark Mq4, a fifth scale mark Mq5 and a sixth scale mark Mq6.
Figure 8B:
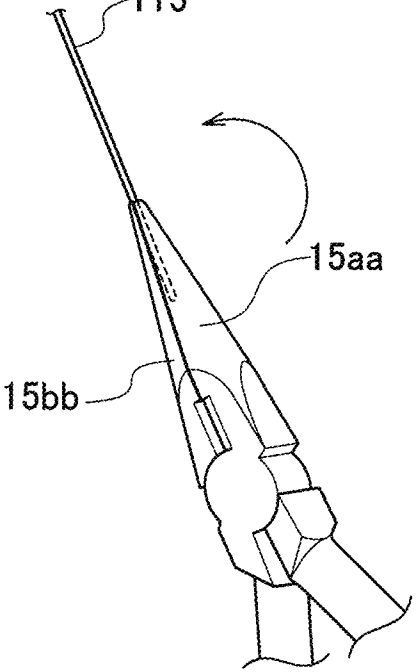
Figure 8C:
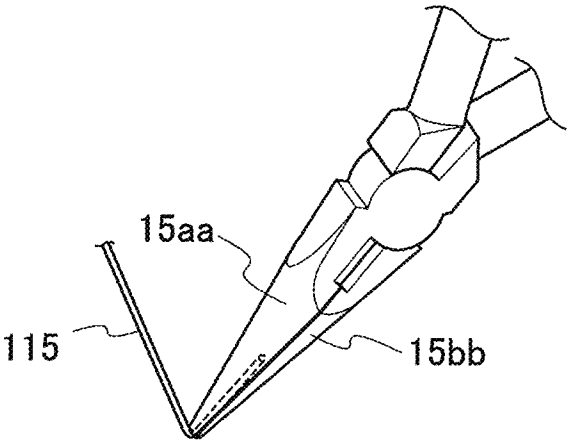
Figure 8D:
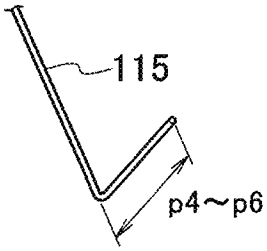

FIG. 7(*a*) to FIG. 7(*d*) and FIG. 8(*a*) to FIG. 8(*d*) are explanatory views for explaining a usage mode of the first embodiment. FIG. 7(*a*) to FIG. 7(*d*) illustrate measurement and bending of the electric wire 115 using the first scale mark Mp1, the second scale mark Mp2 and the third scale mark Mp3. FIG. 8(*a*) to FIG. 8(*d*) illustrate measurement and bending of the electric wire 115 using the fourth scale mark Mq4, the fifth scale mark MO and the sixth scale mark Mq6.

In FIG. 7(*a*) to FIG. 7(*d*), the description is given under a situation where the right arm pinching portion tapered surface 15*aa* of the right arm pinching portion 15*a* of the right arm 13 is viewed from above. Moreover, a description is given of the measurement of the electric wire 115 at the pitch p2 (2/10 inch (5.08 mm)) using the second scale mark Mp2 among the first scale mark Mp1 (pitch p1), the second scale mark Mp2 (pitch p2) and the third scale mark Mp3 (pitch p3).

As illustrated in FIG. 7(*a*), the electric wire 115 is held by the left hand, the pinching portion electric wire length measuring scale-added needle-nose pliers 30 is held by the right hand so that the right arm pinching portion tapered surface 15*aa* faces upward, and the electric wire 115 is bit by the pinching, portion 15.

That is, in order to be parallel to the second scale mark Mp2 (pitch p2) of the right arm pinching portion tapered surface 15*aa* of the pinching portion 15, the electric wire 115 is put from the left side surface of the pinching portion electric wire length measuring scale-added needle-nose pliers 30 across a plane of the left arm pinching portion flat surface portion 15*bc* (that is, to a right end), and the electric wire 115 is bit by the right arm pinching portion flat surface portion 15*ac*. That is, the jumper wire 116 with a length of the pitch p2 (2/10 inch (5.08 mm)) is obtained.

Then, as illustrated in FIG. 7(*b*) and FIG. 7(*c*), the pinching portion electric wire length measuring scale-added needle-nose pliers 30 are rotated counterclockwise, and the pitch p2 (2/10 inch (5.08 mm)) illustrated in FIG. 7(*d*) is obtained.

That is, the electric wire 115 is held by the left hand, the pinching portion electric wire length measuring scale-added needle-nose pliers 30 are held by the right hand, and the electric wire 115 is bit by the right arm pinching portion 15*a* and the left arm pinching portion 15*b* in matching with the first scale mark Mp1, the second scale mark Mp2 and the third scale mark Mp3. In this way, the jumper wires 116 with the pitch p1 (1/10 inch (2.54 mm)), the pitch p2 (2/10 inch (5.08 mm)) and the pitch p3 (3/10 inch (7.62 mm)) can be obtained.

Meanwhile, in the case of obtaining the jumper wires 116 with the pitch p4 (4/10 inch (10.16 mm)), the pitch p5 (5/10 inch (12.70 mm)) and the pitch p6 (6/10 inch (15.24 mm)), these jumper wires 116 are obtained in such a procedure as illustrated in FIG. 8(*a*) to FIG. 8(*d*).

In FIG. 8(*a*) to FIG. 8(*d*), a description is given under a situation where the pinching portion electric wire length measuring scale-added needle-nose pliers 30 is held by the right hand (not illustrated) and the cutting blade portion 11 side faces upward. Moreover, in FIG. 8(*a*) to FIG. 8(*d*), a description is given of the measurement of the electric wire 115 at the pitch p5 (5/10 inch (12.70 mm)) using the fifth scale mark Mq5 among the fourth scale mark Mq4 (pitch p4), the fifth scale mark Mq5 (pitch p5) and the sixth scale mark Mq6 (pitch p6).

As illustrated in FIG. 8(*a*), the electric wire 115 is held by the left hand, and the electric wire 115 is matched with a region from the tip end 19 to the fifth scale mark Mq5. Then, the pinching portion 15 is caused to bite the electric wire 115.

That is, a jumper wire with a length of the pitch p5 (5/10 inch (12.70 mm)) is obtained.

Then, as illustrated in FIG. 8(*b*) and FIG. 8(*c*), the pinching portion electric wire length measuring scale-added needle-nose pliers 30 are rotated counterclockwise, and the electric wire 115 is bent as illustrated in FIG. 8(*d*). That is, an electric wire with a length of the pitch p5 (5/10 inch (12.70 mm)) is obtained. Then, the electric wire in this range of the pitch p5 (5/10 inch (12.70 mm)) is cut.

That is, the electric wire 115 is held by the left hand, the pinching portion electric wire length measuring scale-added needle-nose pliers 30 are held by the right hand, and the electric wire 115 is bit by the right arm pinching portion 15*a* and the left arm pinching portion 15*b* in matching with the fourth scale mark Mq4, the fifth scale mark Mq5 and the sixth scale mark Mq6. In this way, the jumper wires 116 with the pitch p4 (4/10 inch (10.16 mm)), the pitch p5 (5/10 inch (12.70 mm)) and the pitch p6 (6/10 inch (15.24 mm)) can be obtained.

Second Embodiment

Figure 9:
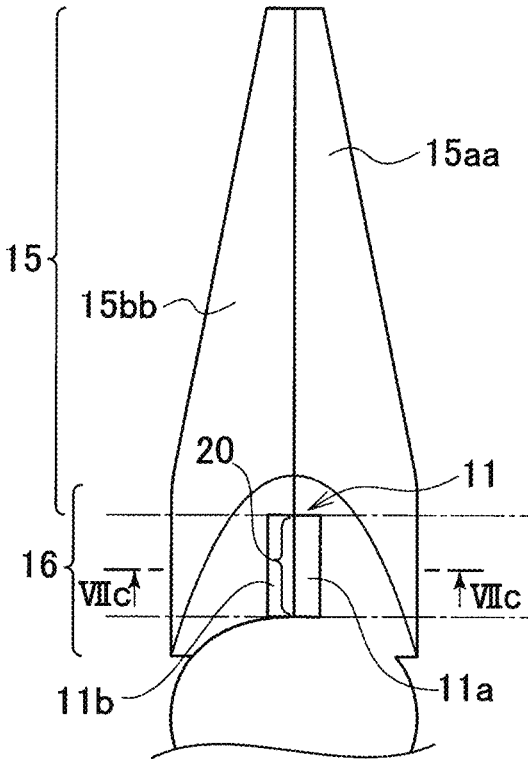
FIG. 9(*a*), FIG. 9(*b*) and FIG. 9(*c*) are explanatory views for explaining a cutting portion of needle-nose pliers according to a comparative example.
Figure 9:
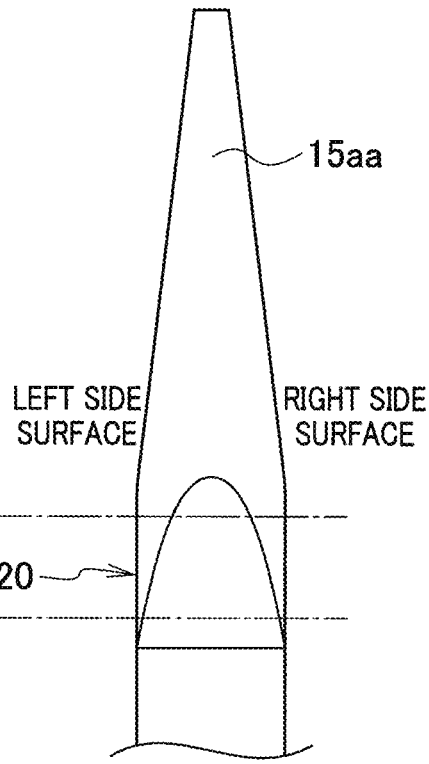
Figure 9:
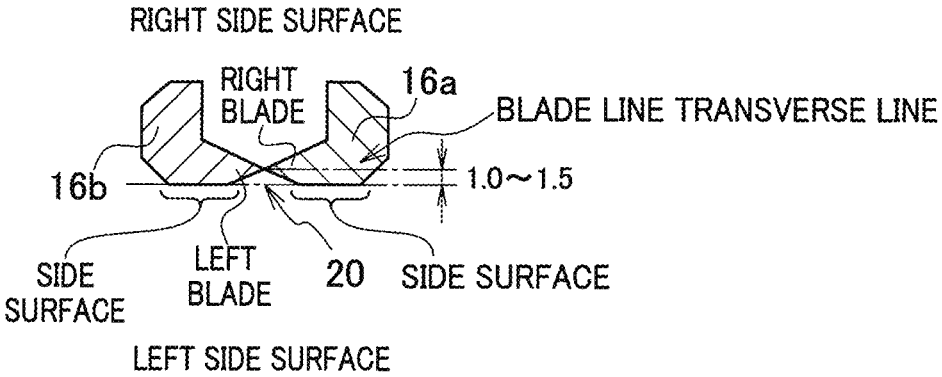

The cutting blade portion 11 according to the above-described first embodiment will be described as a second embodiment. In FIG. 9(*a*) to FIG. 9(*c*), a description of those denoted by the same reference numerals as in the drawings described above will be omitted.

FIG. 9(*a*) illustrates, as a front, a left side surface of a general needle-nose pliers held by the right hand, FIG. 9(*b*) illustrates an upper surface thereof, and FIG. 9(*c*) illustrates a cross-sectional view along a VIIc-VIIc direction of FIG. 9(*a*).

FIG. 9(*a*) illustrates a blade line 20 where the right cutting blade 11*a* and left cutting blade 11*b* of the cutting blade portion 11 engage with each other.

Generally, in many current needle-nose pliers, the cutting blade portion 11 is provided on the cutting portion 16 located behind the pinching portion 15. However, as illustrated in the cross-sectional view of FIG. 9(*c*), the blade line 20 where the right cutting blade 11*a* and left cutting blade 11*b* of the cutting blade portion 11 engage with each other is located inward of a surface (side surface) of the left side surface of the cutting portion 16 by approximately 1 to 1.5 mm.

Therefore, in highly accurately obtaining the jumper wire 116 with a length of 1/10 inch (2.54 mm), an amount of the blade line 20 is non-negligible.

That is, the side surface of the cutting portion 16 disturbs the finger (nail) of the left hand, and accordingly, the electric wire 115 cannot be fed to the blade line 20.

Therefore, it is necessary to shift the finger of the left hand or to replace the needle-nose pliers, which are held by the right hand, by another tool such as nippers (capable of precisely bringing blades thereof to a held portion). That is, operation processes increase, and working accuracy for the jumper wire 116 decreases.

Accordingly, a position of the blade line is changed so as to improve accuracy and easiness as the time of cutting the electric wire 115.

Figure 10A:
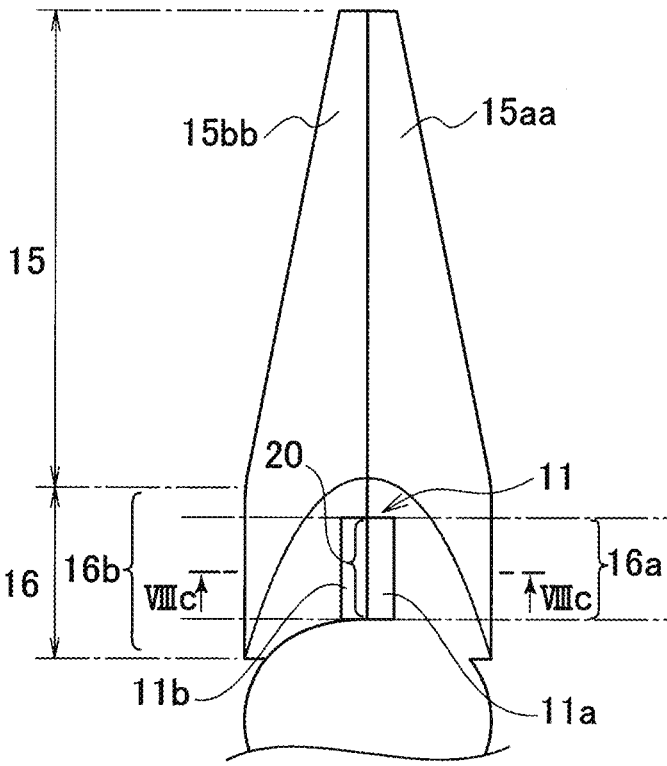
FIG. 10(*a*), FIG. 10(*b*) and FIG. 10(*c*) are an explanatory view for explaining a cutting blade portion 11 of pinching portion electric wire length measuring scale-added needle-nose pliers 30 according to a second embodiment.
Figure 10B:
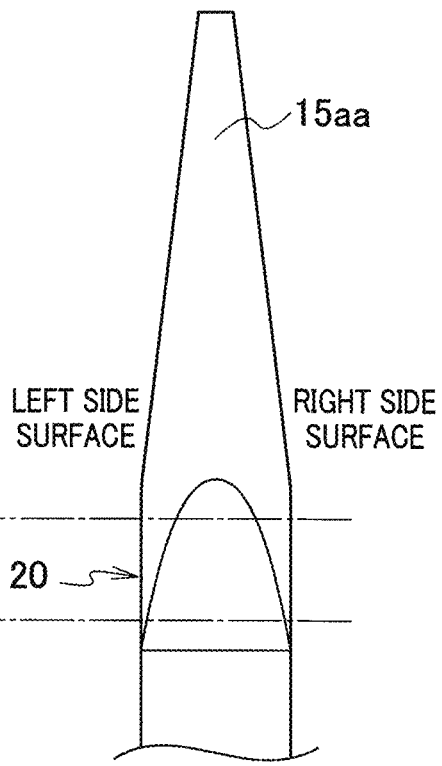
Figure 10C:
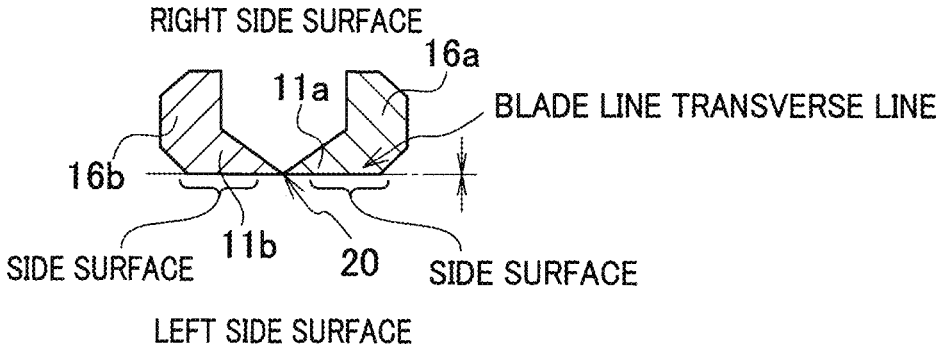

That is, a position of the blade line of the cutting blade portion 11 of the pinching portion electric wire length measuring scale-added needle-nose pliers 30 is formed at such a position as illustrated in FIG. 10(*a*) to FIG. 10(*c*).

FIG. 10(*a*) to FIG. 10(*c*) are explanatory views of the cutting blade portion 11 of the pinching portion electric wire length measuring scale-added needle-nose pliers 30. A description of those denoted by the same reference numerals as in the drawings described above will be omitted. FIG. 10(*a*) illustrates, as a front, a left side surface of the pinching portion electric wire length measuring scale-added needle-nose pliers 30 held by the right hand, FIG. 10(*b*) illustrates an upper surface thereof, and FIG. 10(*c*) illustrates a cross-sectional view along a VIIIc-VIIIc direction of FIG. 10(*a*).

As illustrated in the cross section of FIG. 10(*c*), the right cutting blade 11*a* and the left cutting blade 11*b* which compose the cutting blade portion 11 are molded so that the blade line 20 is flush with the "left side surface".

Figure 11B:
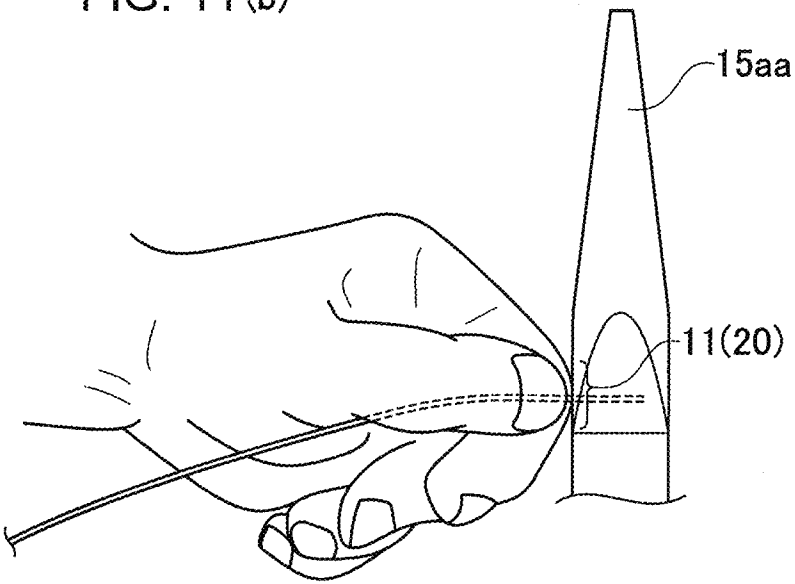
FIGS. 11(*a*) and 11(*b*) are an explanatory view for explaining a usage mode of the cutting blade portion 11 of the pinching portion electric wire length measuring scale-added needle-nose pliers 30 according to the second embodiment.
Figure 11A:
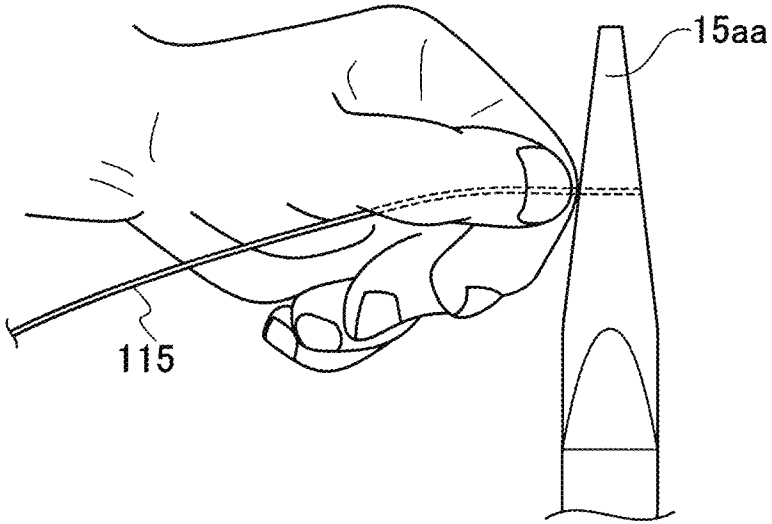

Therefore, as illustrated in FIG. 11(*a*) and FIG. 11(*b*), the electric wire 115 can be held by the thumb and forefinger of the left hand, and can be accurately cut at the position of the cutting blade.

Other Embodiments

Figure 12:
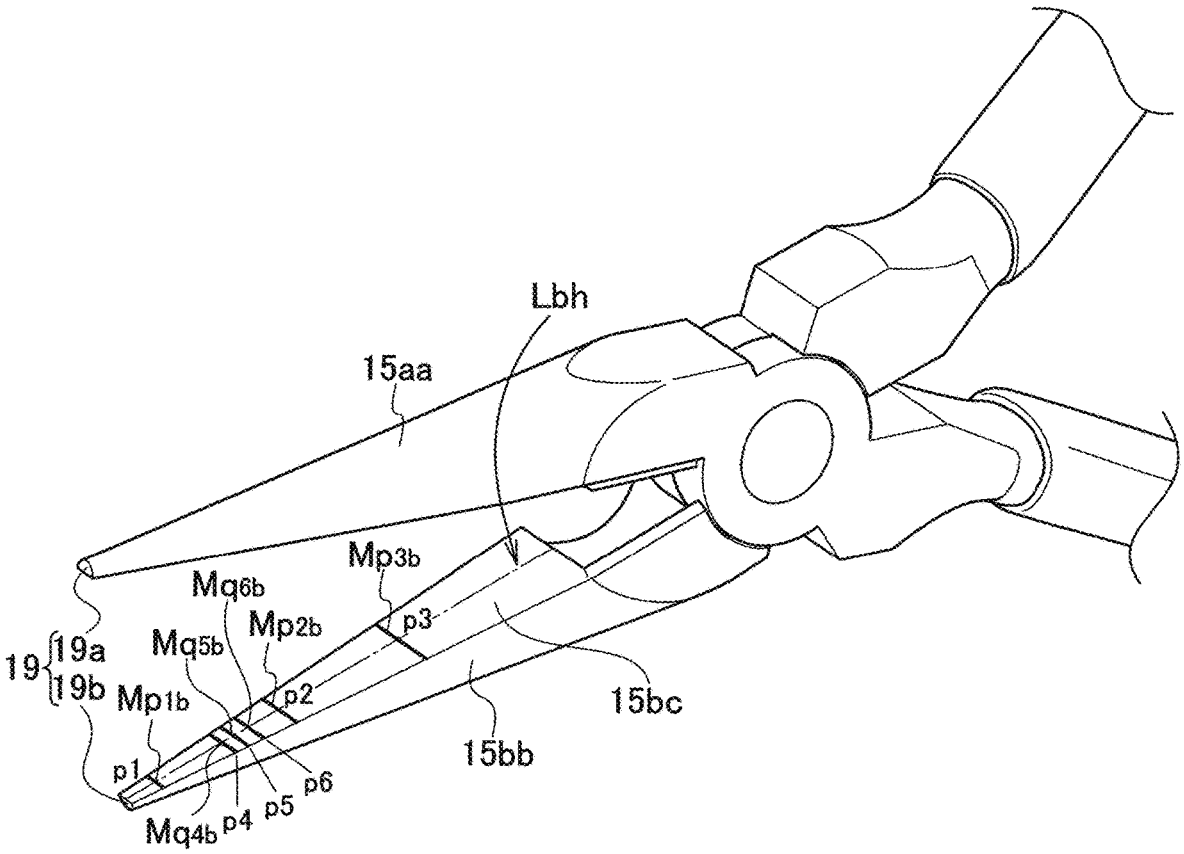
FIG. 12 is an explanatory view according to another embodiment.

In the first embodiment, the scales Mi (ink or grooves) are formed on the right arm pinching portion tapered surface 15*aa* and the left arm pinching portion tapered surface 15*bb*; however, as illustrated in FIG. 12, may be formed on the left arm pinching portion flat surface portion 15*bc* (or the right arm pinching portion flat surface portion 15*ac*). In FIG. 12, the scales Mi are described as Mp1*b*, Mp2*b*, Mp 3*b*, Mq4*b*, Mq5*b* and Mq6*b*.

Moreover, Mp1*b*, Mp2*b*, Mp3*b*, Mq4*b*, Mq5*b* and Mq6*b* are marked respectively with p1, p2, p3, p4, p5 and p6. Furthermore, preferably, Mp1*b*, Mp2*b* and Mp3*b* and Mq4*b*, Mq5*b* and Mq6*b* are colored differently from each other.

When the scales Mi are formed as described above, the electric wire 115 can be bit transversely at Mp1*b*, Mp2*b* and Mp3*b*, and accordingly, the jumper wire 116 becomes straight.

Figure 13:
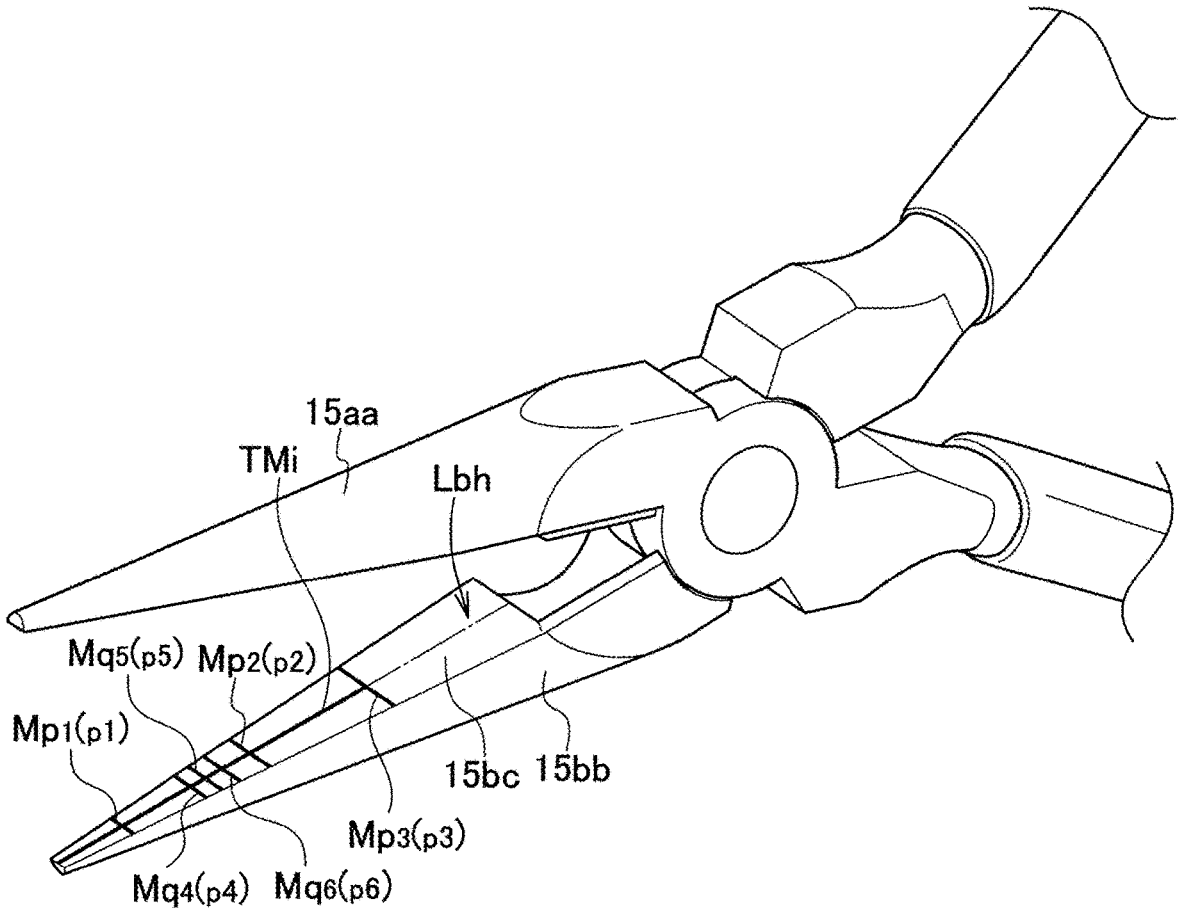
FIG. 13 is an explanatory view according to still another embodiment.
Figure 14:
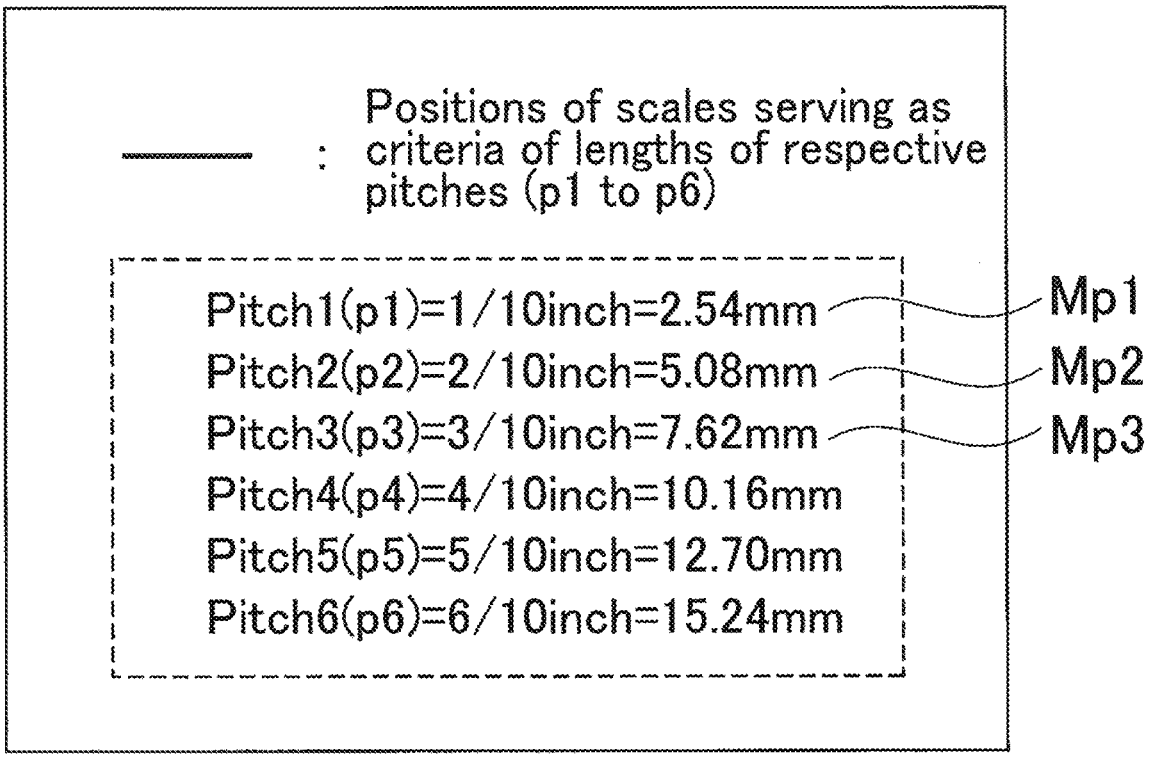
FIG. 14 is an explanatory view of positions of scales serving as criteria of lengths of respective pitches according to an embodiment.

Moreover, as illustrated in FIG. 13, the scales Mi (Mp1, Mp2, Mp3, Mq4, Mq5 and Mq6: ink or grooves) may be formed on the left arm pinching portion flat surface portion 15*bc* (or the right arm pinching portion flat surface portion 15*ac*), and a longitudinal usage groove TMi may be formed from the tip end 19 of the left arm pinching portion flat surface portion 15*bc* (or the right arm pinching portion flat surface portion 15*ac*) to Mp3 located last.

This longitudinal usage groove TMi is formed along the pinching portion flat surface centerline Lh (Lah, Lbh) that passes from the center of the tip end 19 along a center of a rear side of the left arm pinching portion flat surface portion 15*bc* (or the right arm pinching portion flat surface portion 15*ac*).

When the longitudinal usage groove TMi is thus formed, then by Mq4, Mq5 and Mq6, the electric wire 115 becomes straight up to positions thereof, and accordingly, the jumper wire 116 with high dimensional accuracy can be obtained.

Note that the longitudinal usage groove TMi may be further elongated, and a larger number of the scales Mi (ink, grooves) may be provided.

Moreover, the above embodiments have been described on the premise that used are the needle-nose pliers having rounded tapered surfaces; however, the above-described scales Mi may be provided on needle-nose pliers having linear tapered surfaces which are not rounded.

Moreover, the above embodiments have been described on the premise that the universal board 100 is used; however, the board for use may be a breadboard, a perforated Bakelite board or the like, and a unit of a pitch thereof may be 1.29 mm.

Moreover, when the above-described scales Mi are formed of grooves, the electric wire 115 may be bit by the left arm pinching portion flat surface portion 15*bc* that faces the right arm pinching portion flat surface portion 15*ac*, and the electric wire 115 may be trained along the grooves, whereby a jumper wire formed into a substantially cross-sectional shape of the right arm pinching portion 15*a* or the left arm pinching portion 15*b* may be obtained.

INDUSTRIAL APPLICABILITY

The needle-nose pliers according to the present invention are usable for the purpose of obtaining a jumper wire with a predetermined length.

The invention claimed is:

1. Needle-nose pliers in which a scale for obtaining a jumper wire with a required length on a board provided with through holes at a fixed pitch in a matrix is provided on a straight pinching portion with a tapered shape in which a thickness decreases linearly and gradually toward a tip end, wherein the pinching portion is provided with the scale including:

pinching portion lateral width usage scale marks formed at respective positions where respective pinching portion lateral widths which are first integral multiples (except for "0") of the pitch are obtained, the pinching portion lateral width usage scale marks being configured to transversely pinch an electric wire and to obtain a jumper wire with a length that is each of the pinching portion lateral widths; and pinching portion longitudinal length usage scale marks formed at respective positions from a tip end, the respective positions corresponding to respective longitudinal lengths which are second integral multiples (except for "0") not less than the first integral multiples (except for "0") with respect to the pinching portion lateral widths corresponding to the pitch, the pinching portion longitudinal length usage scale marks being configured to pinch the electric wire from the tip end and to obtain a jumper wire with a length that is each of the longitudinal lengths.

2. The needle-nose pliers according to claim 1, wherein the pinching portion includes:

a right arm pinching portion having a right arm pinching portion flat surface portion and a left arm pinching portion having a left arm pinching portion flat surface portion facing the right arm pinching portion flat surface portion in order to pinch a pinching target on a flat surface, in the pinching portion lateral width usage scale marks, both ends of the right arm pinching portion flat surface portion or the left arm pinching portion flat surface portion, both ends having intervals corresponding to the first integral multiples (except for "0") of the pitch, are defined to have the pinching portion lateral widths, and respective positions where the respective pinching portion lateral widths are obtained are defined as pinching portion lateral width usage scale mark positions, and spots of tapered surfaces of either or both of the right arm pinching portion or the right arm pinching portion, the spots serving as the pinching portion lateral width usage scale mark positions, are individually provided as grooves or painted colors, and in the pinching portion longitudinal length usage scale marks, respective positions of the right arm pinching portion flat surface portion or the left arm pinching portion flat surface portion, the respective positions achieving the longitudinal lengths passing from a center of the tip end through a pinching portion flat surface centerline on the right arm pinching portion flat surface portion or the left arm pinching portion flat surface portion, are defined as pinching portion longitudinal length usage scale mark positions, and spots of tapered surfaces of either or both of the right arm pinching portion or the right arm pinching portion, the spots serving as the pinching portion longitudinal length usage scale mark positions, are individually provided as different grooves or painted colors from the grooves or the painted colors in the pinching portion lateral width usage scale marks.

3. The needle-nose pliers according to claim 2, wherein the pinching portion lateral width usage scale marks and the pinching portion longitudinal length usage scale marks are provided at positions on the tapered surface in a direction perpendicular to the pinching portion flat surface centerline in the right arm pinching portion flat surface portion or the left arm pinching portion flat surface portion.

4. The needle-nose pliers according to claim 3, wherein the pinching portion lateral width usage scale marks and the pinching portion longitudinal length usage scale marks are circular color markers, linear grooves or linear color lines, and when the pinching portion lateral width usage scale marks and the pinching portion longitudinal length usage scale marks are the linear grooves or the linear color lines, the pinching portion lateral width usage scale marks and the pinching portion longitudinal length usage scale marks are provided on the tapered surface so as to be perpendicular to the pinching portion flat surface centerline.

5. The needle-nose pliers according to claim 1, wherein the pinching portion includes a right arm pinching portion having a right arm pinching portion flat surface portion and a left arm pinching portion having a left arm pinching portion flat surface portion facing the right arm pinching portion flat surface portion in order to pinch a pinching target on a flat surface, both or either of the pinching portion lateral width usage scale marks and the pinching portion longitudinal length usage scale marks are provided as linear grooves or linear color lines on either or both of the right arm pinching portion flat surface portion or the left arm pinching portion flat surface portion, and the grooves or the color lines are formed so as to be perpendicular to the pinching portion flat surface centerline in the right arm pinching portion flat surface portion or the left arm pinching portion flat surface portion.

6. The needle-nose pliers according to claim 5, wherein, on the right arm pinching portion flat surface portion or the left arm pinching portion flat surface portion, a longitudinal usage groove is formed, the longitudinal usage groove passing from the tip end to the pinching portion flat surface centerline and being perpendicular to each of the pinching portion lateral width usage scale marks and the pinching portion longitudinal length usage scale marks.

7. The needle-nose pliers according to claim 6, wherein the pinching portion lateral width usage scale marks, the pinching portion longitudinal length usage scale marks and the longitudinal usage groove are linear grooves, and the linear grooves are formed to a diameter that is approximately a half of a diameter of the electric wire for use in the board.

8. The needle-nose pliers according to claim 1, wherein each of the longitudinal lengths from the tip end to the pinching portion lateral width usage scale mark positions which are positions of the pinching portion lateral width usage scale marks is represented as:

$$\text{longitudinal length} = a \times (\text{pitch } pi - b)/(c - b)$$

where a: longitudinal length (tapered surface interval) of right arm pinching portion flat surface portion or left arm pinching portion flat surface portion pi: integral multiple (except for "0") of pitch p1 b: lateral width of tip end c: maximum lateral width of pinching portion upper surface.

9. The needle-nose pliers according to claim 1, wherein each of the pinching portion lateral width usage scale marks and the pinching portion longitudinal length usage scale marks is provided with a symbol indicating a corresponding pitch.

10. The needle-nose pliers according to claim 1, wherein a cutting blade portion of the pinching portion is composed of a right cutting blade and a left cutting blade, and in the right cutting blade and the left cutting blade, a blade line is formed so as to be flush with a side surface of the cutting blade portion.

* * * * *